US005624056A

United States Patent [19]

Martindale

[11] Patent Number: 5,624,056

[45] Date of Patent: Apr. 29, 1997

[54] CONDIMENT DISPENSING SYSTEM

[75] Inventor: Richard A. Martindale, Vacaville, Calif.

[73] Assignee: Automatic Bar Controls, Inc., Vacaville, Calif.

[21] Appl. No.: 444,691

[22] Filed: May 19, 1995

[51] Int. Cl.[6] ..... B67D 5/02; B67D 1/10

[52] U.S. Cl. ..... 222/148; 222/334; 222/380; 222/504

[58] Field of Search ..... 222/144.5, 148, 222/334, 380, 504, 571

[56] References Cited

U.S. PATENT DOCUMENTS

| | | | |
|---|---|---|---|
| 3,227,325 | 1/1966 | Bates | 222/334 X |
| 3,830,405 | 8/1974 | Jaeger | 222/334 X |
| 3,979,023 | 9/1976 | Hartley | 222/334 X |
| 4,124,147 | 11/1978 | Priese et al. | 222/380 X |
| 4,477,003 | 10/1984 | Baker et al. | 222/144.5 X |
| 4,484,697 | 11/1984 | Fry, Jr. | 222/334 X |
| 4,781,312 | 11/1988 | Strazdins | 222/380 X |
| 4,863,066 | 9/1989 | Uffenheimer et al. | 222/334 X |
| 5,127,547 | 7/1992 | Gerich | 222/334 X |
| 5,158,210 | 10/1992 | Du | 222/134 |
| 5,366,117 | 11/1994 | Mesenbring et al. | 222/132 |
| 5,368,195 | 11/1994 | Pleet et al. | 222/144.5 X |
| 5,542,574 | 8/1996 | Stern | 222/380 X |

FOREIGN PATENT DOCUMENTS

| | | | |
|---|---|---|---|
| 94008886 | 4/1994 | WIPO | 222/334 |

OTHER PUBLICATIONS

Wunder–Bar Dispensing Systems—Wunder Bar Wine System General Specifications Bag–In–Box Type and Invoice.

*Primary Examiner*—Kevin P. Shaver
*Attorney, Agent, or Firm*—Townsend and Townsend and Crew LLP

[57] ABSTRACT

The invention relates to a condiment dispensing system for dispensing condiment and the like which includes a gas operated pump for moving condiments from a condiment source to a delivery nozzle through a pinch valve that operates to close and open the delivery flow path in response to and absence of gas pressure. A swipe valve to clean the delivery nozzle is also provided.

8 Claims, 3 Drawing Sheets

CONDIMENT DISPENSING SYSTEM

BACKGROUND OF THE INVENTION

The invention relates to a system for dispensing condiments or the like. It is specially adapted to dispense condiments that contain solids or semi solids or particles such as is found in thousand island dressing and various "secret sauces" favored by restaurants without fouling the dispensing system and without objectional drip from the dispensing nozzle. The invention provides for dispensing controlled portions of the condiment rapidly and efficiently.

Heretofore there have been many systems developed for dispensing condiments automatically and in controlled portions. For example, U.S. Pat. No. 5,366,117 issued to John M. Mesenbring et al. provides a condiment dispensing system. The Background section of that patent describes many of the prior art methods and systems for dispensing condiments and the problems associated therewith. The Mesenbring et al. patent provides a system for selectively dispensing condiments for items of food, including a plurality of condiment containers, a dispenser head having a plurality of input passages, an outlet nozzle, and valves for controlling fluid flow from each of the input passages to the outlet nozzle, a plurality of fluid flow lines, with a line connecting each condiment container to a corresponding dispenser head input passage, and a fluid pump in each of the fluid flow lines whereby an operator can dispense selected condiments in controlled portions if desired from the nozzle onto a food item. Arrangements for daily and bi-weekly sanitizing of the system are also provided. The patent provides for the use of a dispensing head having a plurality of input passages which can be fouled during delivery of viscous condiments particularly by condiments that contain solid or semi solid particles.

Another approach to dispensing condiments is disclosed in U.S. Pat. No. 5,158,210 to Benjamin R. Du. The Background section of the Du patent also discusses prior art methods of dispensing condiments. The Du patent provides an improved condiment dispensing system for delivering a measured quantity of condiment as a constant flow rate. The device comprises a pump which is fluidly connected to a condiment source and a dispensing apparatus. The dispensing apparatus includes a valve assembly which is connected to both a pressurized fluid source and to the pump whereby actuation of a valve assembly contained on the surface of the dispensing apparatus causes a measured quantity of condiment to be dispensed from an outlet nozzle contained thereon. The pump of the Du patent is provided with two cavities which in operation alternately withdraw a predetermined quantity of condiment from a condiment source and dispense the predetermined quantity of condiment at a desired location.

There is still need for a condiment dispensing system which can handle condiments including viscous condiments and/or condiments with solid or semi solid particles in an efficient manner without fouling and without unwanted drip from the dispensing nozzle.

SUMMARY OF THE INVENTION

This invention provides a condiment dispensing system which includes a rack for holding a source of condiment. The source of condiment is preferably a condiment containing collapsible bay having an outlet port. A gas driven pump is provided and has a condiment inlet and a condiment outlet and a gas inlet for operating the pump. Conduit means connect the outlet port of the source of condiment with the condiment inlet of the pump. A source of gas such as $CO_2$ or air under pressure is used in the system to power the pump and to operate the valves used in the system. Gas conduit means connect the source of gas with the gas inlet of the pump. A delivery nozzle is used to dispense the condiment. Delivery conduit means connect the delivery nozzle with the condiment outlet of the pump. A pinch valve means is connected in the delivery conduit means between the condiment outlet and the delivery nozzle to control flow therebetween. The pinch valve includes a normally open central flow path for condiment flow and bladder means for closing the flow path of the valve in response to gas pressure. A control conduit connects the source of gas with the pinch valve and is operable to pressure the bladder means to close the pinch valve when gas under pressure is flowed thereto. Control means are used to activate the pump for dispensing condiment through the delivery nozzle. The control means include means to exhaust gas from the control conduit to open the pinch valve and simultaneously start the pump to provide condiment delivery through the nozzle. The control means include means to stop the pump and to provide gas under pressure to the control conduit means to close the pinch valve. The system may also include a swipe valve connected downstream of the pinch valve and the delivery nozzle. The swipe valve has a normally open central opening therein for condiment flow therethrough and a movable valve element for closing the normally open central opening in response to gas pressure. Conduit means are provided to connect the swipe valve to the source of gas under pressure for use in operating the swipe valve.

OBJECTS OF THE INVENTION

It is a particular object of the present invention to provide an improved system for dispensing condiment or the like which system can handle viscous condiments and condiments containing solid or semi solid particulate matter without jamming and with positive flow control and in controlled portions. Other objects and advantages of the present invention will be apparent from the following detailed description read in view of the accompanying drawings which are made a part of this specification.

DETAILED DESCRIPTION OF THE INVENTION

Figure 1:
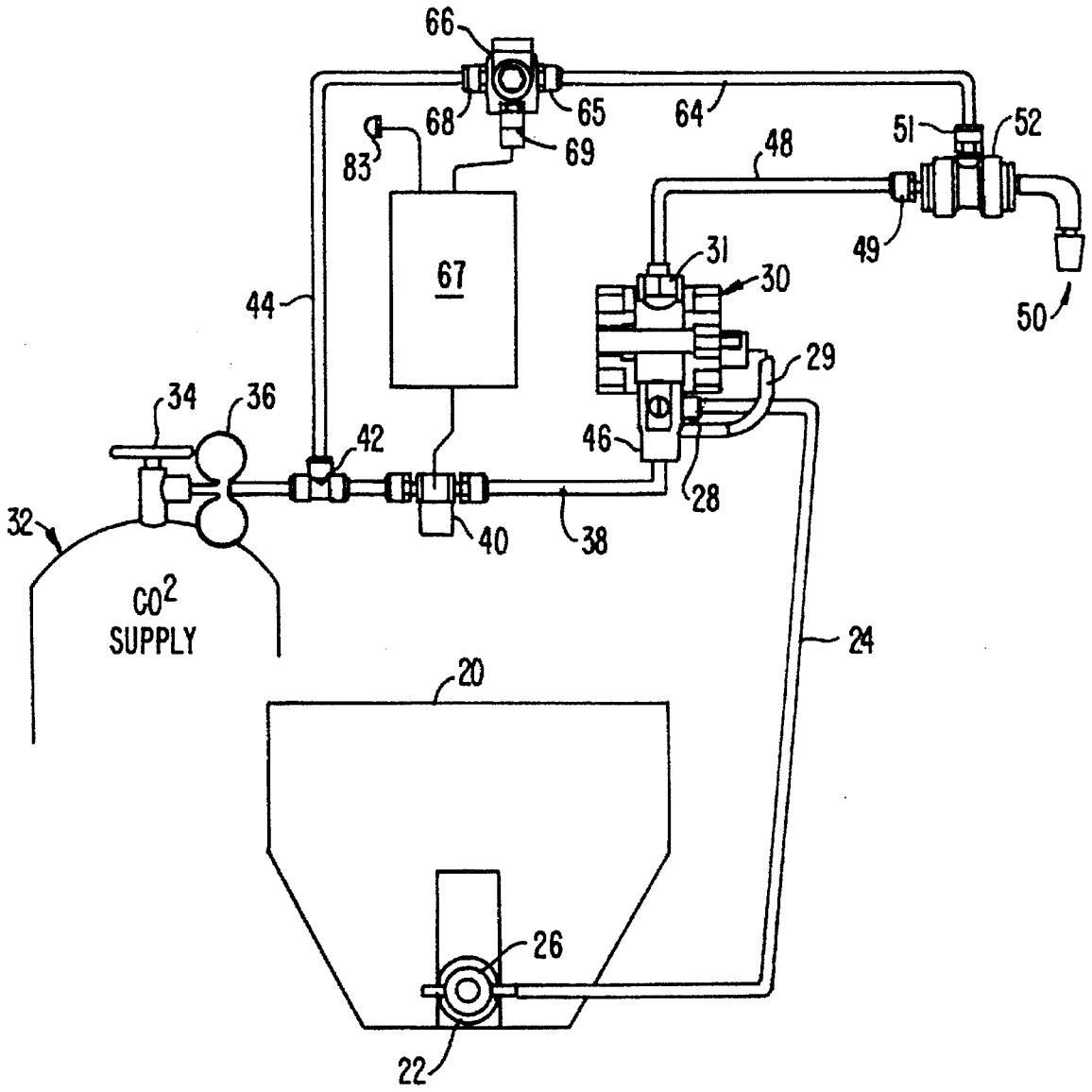
FIG. 1 is a schematic diagram illustrating the preferred system for dispensing condiment and shows an embodiment of apparatus assembled in accordance with the present invention.

The preferred system for dispensing condiment or the like is illustrated schematically in FIG. 1. The condiment dispensing system of FIG. 1 provides for handling condiments in a manner to prevent fouling of the system, particularly at the delivery nozzle and the resultant dripping that can occur when the nozzle is fouled or partially plugged. This is true.

particularly when the condiment contains solid or semi solid particles such as is found in thousand island dressing or various "secret sauces" found in many restaurants.

Referring now specifically to FIG. 1, a rack 20 for holding a source of condiment is shown. As is well known, condiment is commercially available in convenient condiment bags. The bags are made to be hung on a rack or to be otherwise supported at a desired location and the condiment withdrawn for use. Thus rack 20 may be in a form suitable for hanging a condiment bag. Alternatively, rack 20 may be formed in the shape of a cradle for supporting the condiment bag. In any event, the bags are formed with a condiment outlet 22 adapted to be connected to a conduit 24 by means of a suitable connector 26. Conduit 24 provides a flow path from the condiment bag to the suction or inlet side 28 of a condiment pump 30.

The condiment pump 30 is preferably a dual diaphragm type pump. There are commercially available pumps that are useful in the present invention. One such pump for example is Model No. "Smooth" 166-200-11 by Shurflow of Santa Ana, Calif. 92706. However, any suitable type pump may be used. The pump is preferably gas driven. Thus a source of gas, for example $CO_2$ or air source 32 is operatively connected to pump 30 by means of hand operated valve 34, gas pressure regulator 36 and conduit 38. A gas solenoid valve 40 is preferably connected into conduit 38. A T connection 42 is also connected into conduit 38 between gas source 32 and valve 40 so that a portion of the gas can be diverted to conduit 44 as hereinafter described. Conduit 38 connects to the pump 30 at gas inlet 46 to drive pump 30. Conduit 29 provides for exhausting the gas from the pump. Conduit 48 provides a flow path for condiment from pump 30 to a delivery nozzle 50 through pinch valve 52. Thus, when pump 30 is activated by gas from the gas source 32, and the various valves 66, 40 operated as hereinafter described, condiment is sucked out of the condiment bag located in rack 20 moved through the pump 30, pushed through the outlet 31 of the pump 30 and moved through conduit 48 through pinch valve 52 to nozzle 50 for delivery.

Figure 3:
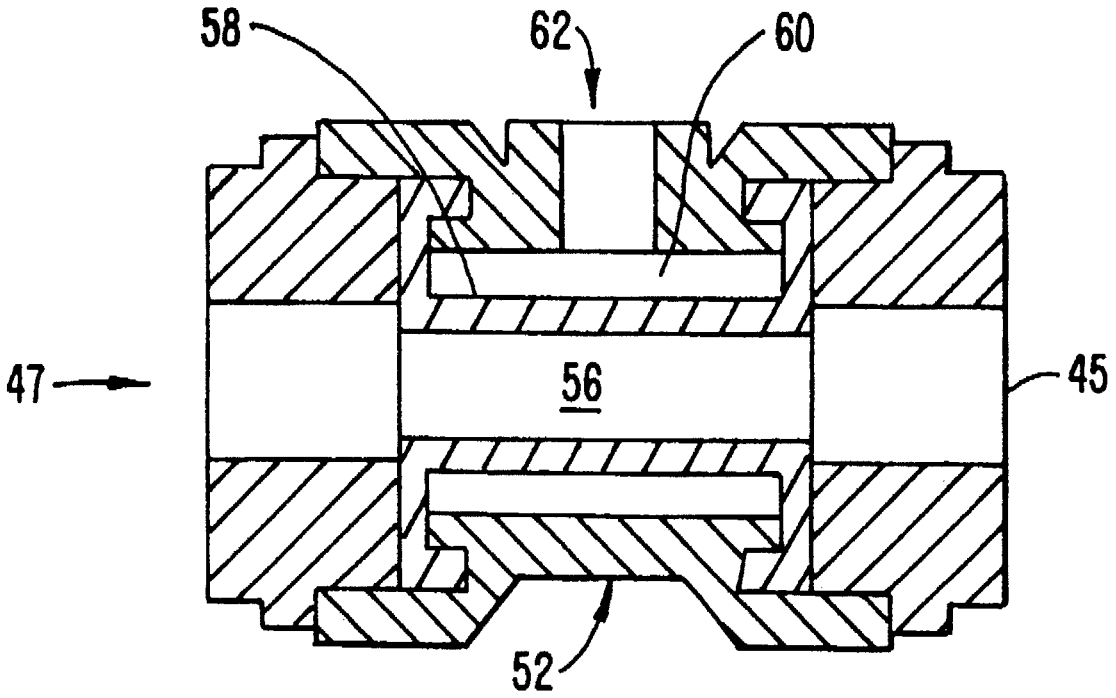
FIG. 3 is a sectional view of the preferred pinch valve useful with the apparatus of the present invention.

A gas controlled "pinch valve" indicated generally by the numeral 52 is located on conduit 48 upstream of the condiment delivery nozzle 50. Thus, the pinch valve 52 is located between the outlet 31 of the pump 30 and the delivery nozzle 50. Preferably the pinch valve 52 is located adjacent the delivery nozzle 50. The pinch valve is a commercially available product. Suitably available pinch valves are Models No. AP-6018 and AP-6047 of Richway Industries, Janesville, Iowa 50647 The point of dispense or nozzle 50 may vary in size, type, shape and multiplicity, depending upon the application and types of condiments dispensed. The pinch valve is connected to conduit 48 by connector 49 at the opening 47 in the upstream end of the pinch valve. The downstream end 45 of the pinch valve 51 is connected to the delivery nozzle 50. FIG. 3 is an enlarged sectional view of the pinch valve 52. The pinch valve has a central flow opening 56 which, when open, permits flow of condiment through the interior of pinch valve 52. Thus, condiment flows from conduit 48 into the pinch valve 52 at connector 49 through the interior 56 of the pinch valve to dispensing nozzle 50. The pinch valve is provided with an annular valve bladder 58. The bladder 58 is positioned in the body of valve 52 and has an annular chamber 60 formed outside the bladder 58. A gas entry port 62 is provided to the valve 52 through the valve body. When gas under pressure is injected through the entry port 62, the bladder is compressed to close flow path 56 to stop flow therethrough. When the gas is exhausted through port 62 as is hereinafter described, the bladder 58 returns to its original shape, the central opening 56 opens and flow through passage 56 may be resumed.

Gas is supplied to the pinch valve 52 and exhausted therefrom by means of conduit 64 which is connected to the pinch valve 52 at port 62 by means of connector 51. The gas is supplied from gas source 32 through conduit 44 and three way valve 66. Three way gas valves are commercially available. For example, three way valve Model No. 8320G13024VDC of Automatic Switch Co., Florham Park, N.J. 07932 is useful in accordance with the invention. Conduit 44 is connected to the inlet side of three way valve 66 by means of a suitable fitting 68. The outlet side of three way valve 66 is connected to conduit 64 by means of a suitable fitting 65. A gas exhaust port 69 is also provided in the three way valve 66 so that gas may be exhausted from conduit 64 when it is desired to open the pinch valve 52 to permit condiment flow therethrough.

A p.c. control box 67 is conveniently located in the system and is operably connected to operate gas solenoid valve 40 and three way valve 66. A commercially available gas solenoid valve useful int he present invention is Model U8225 B2V-24VDC by Automatic Switch Co., Florham Park, N.J. 07932. The p.c. control box 67 is activated by actuator button 83. The p.c. control circuitry can be set to provide any operational time desired. Thus, an operation at a time of two to five seconds might be desirable. In operation, depressing the actuator button 83 activates an electronic circuit within the p.c. control box 67. The electronic circuit is present to turn on the two gas valves 40 and 66 in the system for a predetermined period of time. The two way gas solenoid valve 40 opens to allow $CO_2$ gas or air supply to flow to the inlet fitting 46 on the pump. The three way gas valve 66 activates to allow pressure in conduit 64 to be exhausted through the valve 66 at exhaust port 69 while simultaneously closing off the $CO_2$ or air supply to the conduit 64. The absence of pressure on the pinch valve 52 allows the pinch valve bladder 58 (FIG. 3) to open.

During the portion of the cycle when the valves 40 and 52 permit gas pressure on the pump, and exhaust pressure in conduit 64 causing an open pinch valve bladder 58, the pump operates pushing condiment through the outlet 31 of the pump 30 through the conduit 48 to the point of dispense at nozzle 50. The pump 30 is simultaneously drawing (sucking) condiment from the condiment bag through the condiment bag connector 22 and conduit 24.

After the p.c control box 67 has "timed out" the two air valves 66, 40 deactivate. That is, valve 66 opens to permit flow from gas source 32 to conduit 64 and thus to pinch valve 52 to close the pinch valve. Valve 40 is switched to close gas from the gas sources 2 to the pump 30 to stop the pump 30. This simultaneously applies pressure to the pinch valve 52 by gas pressure in conduit 64, while eliminating pressure to the pump. The pump 30 stops pumping, the pinch valve 52 closes off due to reintroduced pressure in conduit 64. The condiment dispensing system is ready to again be activated by an operator depressing activator button 83.

Figure 2:
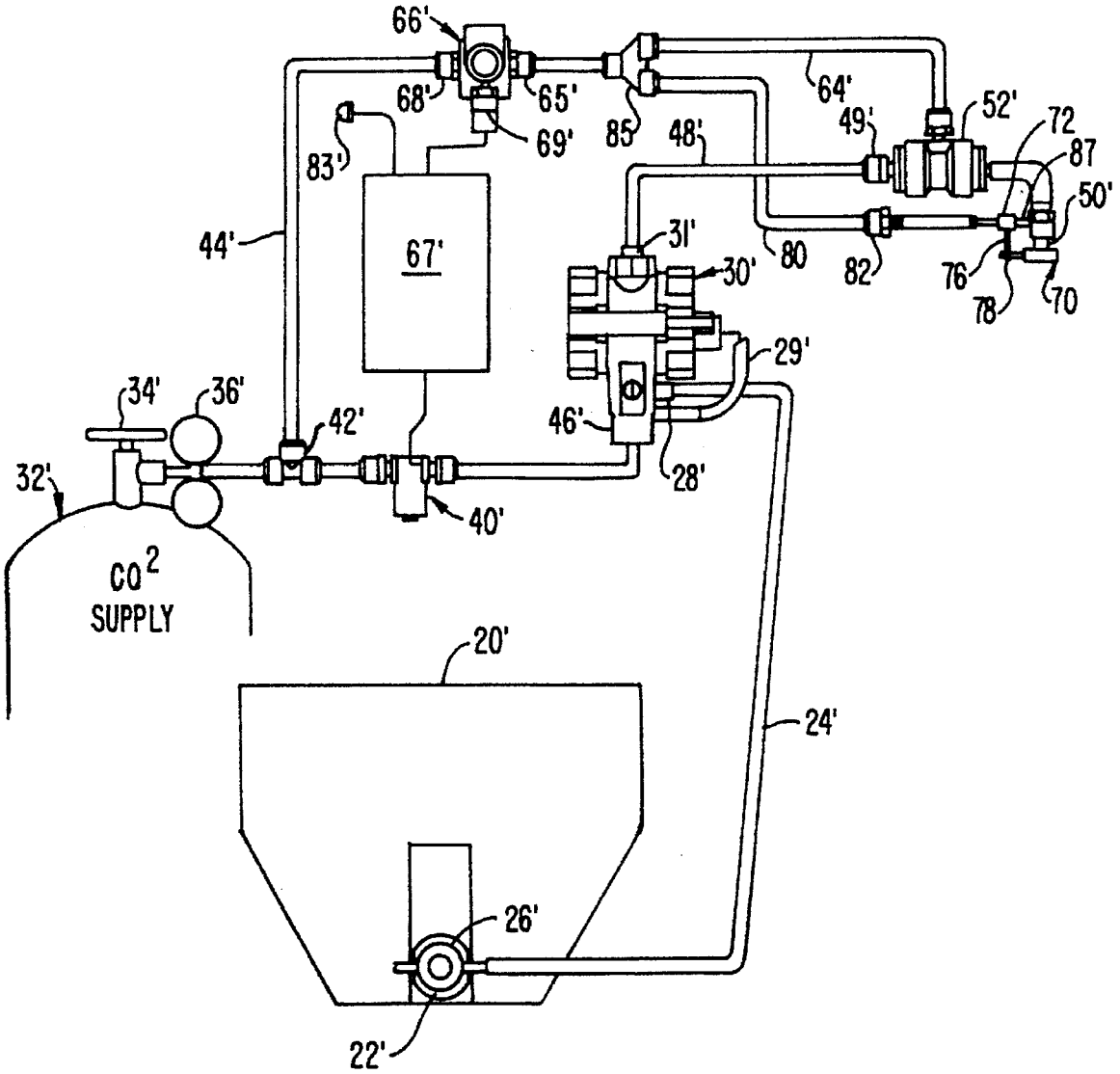
FIG. 2 is a schematic diagram illustrating an alternative system for dispensing condiment and shows another embodiment of apparatus assembled in accordance with the present invention.

FIG. 2 shows an alternative embodiment of apparatus assembled in accordance with the present invention. The condiment dispensing system of FIG. 2 is similar in many respects to the preferred system illustrated in FIG. 1. Parts and elements in the embodiment of FIG. 2 which are the same as the parts or elements illustrated in the system of FIG. 1 will be given the same numbers followed by a prime indication i.e., for the pump "30'."

Figure 4:
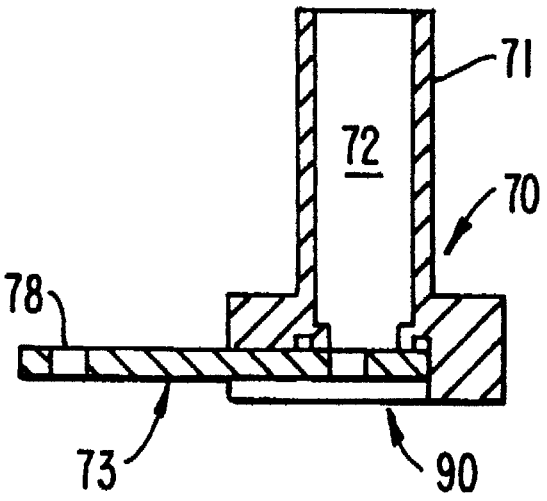
FIG. 4 is a sectional view of a slide valve useful with the alternative embodiment of apparatus of the present invention.

The embodiment illustrated in FIG. 2 provides a "swipe valve" means to clean the tip or end of the delivery nozzle 50' during the closing or shut off portion of the condiment delivery cycle. In addition, the swipe valve by sealing off the nozzle 50' at the point of dispense keeps the condiment in the system (conduit 64' and valve 52') fresh and prevents "drying out." Thus, a swipe valve indicated generally by the number 70 is connected onto the end of the delivery nozzle 50'. A sectional view of the swipe valve 70 is provided in FIG. 4. As there shown, the swipe valve 70 included a valve body portion 71 having a central opening 72 therethrough. The upper portion of valve body 71 is adapted to be connected to the delivery nozzle 50' and when the central opening 72 is unobstructed, condiment may flow through the opening 72 for delivery. The swipe valve 70 also included a movable valve element 73 (shown in the retracted or open position in FIG. 4) which may be moved reciprocally to open or close the central flow path 72 of the swipe valve 70. A gas ram 75 is connected to the movable valve element 73 by means of a connecting pin 76 which extends from the forward end 77 of the gas ram 75 to the hole 78 provided in the movable valve element 73. The gas ram 75 is connected to three way valve 66' by means of conduit 80 connector 82 and Y connector 85. When three way valve 66' is in the exhaust position and gas in conduits 80 and 64' have been exhausted through port 69', and there is no pressure in conduits 80 and 64' the absence of gas pressure in line 80 allows a spring 89 that is located between the delivery nozzle 50' and the swipe valve/gas ram connection to push the movable valve element 73 back to the open position as illustrated in FIG. 4. Conversely, when valve 66' is activated to repressure lines 64' and 80 the movable valve element 73 is moved to close flow path 72. The closing action swipes off any excess condiment that may be extending out of the lower end 90 of the valve and also seals off the condiment upstream in the system to help the condiment from drying out during periods of inactivity.

The operation of the embodiment of FIG. 2 begins when actuator button 83' is depressed by an operator. This action activates an electronic circuit within the p.c. control box 67'. The p.c. control box 67' may be programmed for any desirable operating time. The electronic circuit in the p.c. control box 67' causes the two gas valves 40 and 66 in the system to be moved to a dispensing mode for a predetermined period of time. The time may be adjusted by making a simple change in the p.c. control box 67'. Thus, in the dispensing mode the two way gas solenoid valve 40 opens to allow $CO_2$ gas to flow to the inlet fitting 46' on the pump to thus start the pump. The three way gas valve 66' activates to allow pressure from the gas source through the three way valve to the pinch valve 52' to be exhausted from the three way valve exhaust port 69', while simultaneously closing off the $CO_2$ supply at valve 66'. The absence of pressure on the pinch valve 52' allows the pinch valve bladder 58' (FIG. 3) to open. Similarly, the absence of pressure on the swipe valve 70 allows spring 82 to open flow path 72 of the swipe valve. Thus, condiment is dispensed by operation of pump 30' pushing condiment out of the dispensing nozzle 50' through the open swipe valve 70.

Thus, during the dispensing portion of the cycle when the valve 40' permits gas pressure on the pump, and valve 66' has exhausted gas from conduit 64' through port 69' causing an opening of the pinch valve bladder 58', the pump diaphragm begins to move, pushing condiment through the outlet 31' of the pump 30' down the conduit 48' to the point of dispersal at nozzle 50' and swipe valve 70, while the pump 30' is simultaneously drawing (sucking) condiment from the condiment bag through the condiment bag connector 22' and conduit 24'.

After the p.c. control box 67' has "timed out" the two gas valves 66', 40' deactivate That is valve 66' opens flow from gas source 32' to conduit 64' and thus to pinch valve 52' and swipe valve 70. Valve 40' is switched to close gas from the gas source 32' to the pump 30' stopping the pump. The valves 66' and 40' thus simultaneously apply pressure to the pinch valve 52' and swipe valve 70 by gas pressure in conduit 64' and conduit 80, while eliminating pressure to the pump 30'. The pump 30' stops pumping, the pinch valve 52' closes off due to reintroduced pressure in conduit 64' and the swipe valve 70 closes. The condiment dispensing system is ready to again be activated by an operator depressing activator button 83'.

In addition to other advantages of the present condiment dispensing system, the following advantages are evident. The swipe valve "cleans" the end of the nozzle off during the closing portion of the cycle which effectively eliminates the condiment "drip" or residue that will normally hang from the end of the nozzle. Additionally, the swipe valve seals off the point of dispense which keeps the condiment fresh and prevents "drying out". The pinch valve provides an effective seal that eliminates valve "fouling" and the resultant dripping, especially with condiments that contain "solid particulates" as found in thousand island dressing, "secret sauces", etc. by virtue of the design which has no springs, valve mechanisms, etc., in the line of flow which can cause food items to collect and congeal. The pinch valve operates by "chocking" off the flow path and therefore, is resisting to fouling. The p.c. control box allows for varying the time that the valves are energized which in turn allows for varying the amount of condiment dispensed with one actuation of the actuator button. The $CO_2$ or air supply regulator allows the pressure to be varied to provide for optimum rate of flow depending on the viscosity of the condiment as well as the distance from the pump top the point of dispense. Additional advantages of the present system of condiment dispensal will be apparent to those skilled in the art upon reading this disclosure.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. Variations and changes may be made by others without departing from the spirit of the present invention. Accordingly, all such variations and changes which fall within the spirit and scope of the present invention as defined in the following claims are expressly intended to be embraced thereby.

What is claimed is:

1. A condiment dispensing system comprising a rack for holding a source of condiment having an outlet port; a pump having a condiment inlet and a condiment outlet; means for operating said pump; conduit means connecting the outlet port of the source of condiment with the condiment inlet of said pump; a delivery nozzle; delivery conduit means connecting said delivery nozzle with the condiment outlet of said pump; pinch valve means on said delivery conduit means between said condiment outlet and said delivery nozzle, said pinch valve means including a normally open central flow path for condiment flow; means for closing said flow path; and control means for activating said pump for dispensing condiment through said delivery nozzle, said control means including means to open said pinch valve and simultaneously start said pump to provide condiment delivery through said nozzle and means to stop said pump to close said pinch valve.

2. The system of claim 1 further characterized by a swipe valve connected downstream of said pinch valve and said delivery nozzle; said swipe valve having a normally open central opening therein for condiment flow therethrough and a movable valve element for closing said normally open central opening.

3. A condiment dispensing system comprising a rack for holding a source of condiment having an outlet port; a gas driven pump having a condiment inlet and a condiment outlet and a gas inlet for operating said pump; conduit means connecting the outlet port of the source of condiment with the condiment inlet of said pump; a source of gas under pressure; gas conduit means connecting said source of gas with the gas inlet of said pump; a delivery nozzle; delivery conduit means connecting said delivery nozzle with the condiment outlet of said pump; pinch valve means on said delivery conduit means between said condiment outlet and said delivery nozzle, said pinch valve including a normally open central flow path for condiment flow; means for closing said flow path in response to gas pressure; control conduit means connecting said source of gas with said pinch valve and operable to close said pinch valve when gas under pressure is flowed thereto and control means for activating said pump for dispensing condiment through said delivery nozzle, said control means including means for simultaneously operating said pump to dispense conduit through said delivery nozzle and means to close said pinch valve to stop condiment flow and to stop said pump.

4. The system of claim 3 further characterized by a swipe valve connected downstream of said pinch valve and said delivery nozzle; said swipe valve having a normally open central opening therein for condiment flow therethrough and a movable valve element for closing said normally open central opening.

5. A condiment dispensing system comprising a rack for holding a source of condiment having an outlet port; a gas driven pump having a condiment inlet and a condiment outlet and a gas inlet for operating said pump; conduit means connecting the outlet port of the source of condiment with the condiment inlet of said pump; a source of gas under pressure; gas conduit means connecting said source of gas with the gas inlet of said pump; a delivery nozzle; delivery conduit means connecting said delivery nozzle with the condiment outlet of said pump; pinch valve means on said delivery conduit means between said condiment outlet and said delivery nozzle, said pinch valve means including a normally open central flow path for condiment flow and bladder means for closing said flow path in response to gas pressure; control conduit means connecting said source of gas with said pinch valve and operable to pressure said bladder means to close said pinch valve when gas under pressure is flowed thereto and control means for activating said pump for dispensing condiment through said delivery nozzle, said control means including means to exhaust gas from said control conduit means to open said pinch valve and simultaneously start said pump to provide condiment delivery through said nozzle and means to stop said pump and to provide gas under pressure to said control conduit means to close said pinch valve.

6. The system of claim 5 further characterized by a swipe valve connected downstream of said pinch valve and said delivery nozzle; said swipe valve having a normally open central opening therein for condiment flow therethrough and a movable valve element for closing said normally open central opening in response to gas pressure and conduit means connecting said swipe valve to said source of gas under pressure.

7. A condiment dispensing system comprising a rack for holding a source of condiment having an outlet port; a gas driven pump having a condiment inlet and a condiment outlet and a gas inlet for operating said pump; conduit means connecting the outlet port of the source of condiment with the condiment inlet of said pump; a source of gas under pressure; gas conduit means connecting said source of gas with the gas inlet of said pump; a delivery nozzle; delivery conduit means connecting said delivery nozzle with the condiment outlet of said pump; pinch valve means on said delivery conduit means between said condiment outlet and said delivery nozzle, said pinch valve including a normally open central flow path for condiment flow and bladder means for closing said flow path in response to gas pressure; control conduit means connecting said source of gas with said pinch valve and operable to pressure said bladder means to close said pinch valve when gas under pressure is flowed thereto and control means for activating said pump for dispensing condiment through said delivery nozzle, said control means including a time delay actuator for opening said pinch valve to condiment flow and simultaneously operating said pump for a predetermined time to dispense conduit through said delivery nozzle and then providing gas under pressure into said control conduit to pressure said bladder to close said pinch valve to stop condiment flow and to stop said pump after the predetermined time has elapsed.

8. The system of claim 7 further characterized by a swipe valve connected downstream of said pinch valve and said delivery nozzle; said swipe valve having a normally open central opening therein for condiment flow therethrough and a movable valve element for closing said normally open central opening in response to gas pressure and conduit means connecting said swipe valve to said source of gas under pressure for maintaining said movable valve element and control means for opening said swipe valve while said pump is operating and closing said swipe valve when said pump is stopped.

* * * * *